US006135080A

United States Patent [19]

Kallina

[11] Patent Number: 6,135,080

[45] Date of Patent: Oct. 24, 2000

[54] VALVE GUIDE SYSTEM AND METHOD

[76] Inventor: Henry D. Kallina, 5693 E. Valley High Dr., Parker, Colo. 80134

[21] Appl. No.: 09/211,158

[22] Filed: Dec. 14, 1998

[51] Int. Cl.[7] ..... F01L 3/02

[52] U.S. Cl. ..... 123/188.9

[58] Field of Search ..... 123/188.9, 188.8

[56] References Cited

U.S. PATENT DOCUMENTS

| | | | |
|---|---|---|---|
| 908,604 | 1/1909 | Odenkirchen . | |
| 1,503,257 | 7/1924 | Parker et al. | 123/188.9 |
| 2,222,457 | 11/1940 | Scheibe . | |
| 2,797,676 | 7/1957 | Van Skike | 123/188.9 |
| 3,577,972 | 5/1971 | Moray | 123/188.9 |
| 3,885,546 | 5/1975 | Foley et al. . | |
| 4,124,220 | 11/1978 | Leone et al. . | |
| 5,503,123 | 4/1996 | Carter | 123/188.9 |
| 5,507,257 | 4/1996 | Sakai et al. | 123/188.9 |
| 5,662,078 | 9/1997 | Adegawa | 123/188.9 |
| 5,899,185 | 5/1999 | Ohtsubo | 123/188.9 |

FOREIGN PATENT DOCUMENTS

| | | |
|---|---|---|
| 924584 | of 1909 | France . |
| 159822 | of 1875 | United Kingdom . |
| 196653 | of 1877 | United Kingdom . |
| 202028 | of 1878 | United Kingdom . |

*Primary Examiner*—Marguerite McMahon

*Attorney, Agent, or Firm*—Ramon L. Pizarro; Edwin H. Crabtree

[57] ABSTRACT

A system and method for supporting a valve stem of a poppet valve that is held in a normally closed position by a valve spring, the poppet valve being adapted for use in an internal combustion engine. The system includes a valve guide insert with a body having a first end, a second end, an aperture extending between the first end and the second end, an external surface having a protrusion near the second end. The first end of the guide will preferably include a threaded portion which will cooperate with a nut to provide tension to the valve guide insert. The system also includes a spring seat that includes a thermal barrier adapted for mounting about the stem and for accepting the valve spring, so that the spring may be placed over the thermal barrier and connected to the stem, allowing the stem to be supported by the spring and the valve guide insert.

18 Claims, 4 Drawing Sheets

KNOWN ART

KNOWN ART

VALVE GUIDE SYSTEM AND METHOD

BACKGROUND OF THE INVENTION (a) Field of the Invention

This invention generally relates to a system and method for supporting a valve stem of the type commonly used with valves used to deliver or exhaust gases from the combustion chamber of an internal combustion engine. More particularly, but not by way of limitation, to a valve guide insert and valve stem support components for a poppet type valve in an internal combustion engine.

(b) Discussion of Known Art

Many internal combustion engines, and particularly four stroke engines, use valves to control the ingress and egress of gases to used or produced in operation. These valves typically include a poppet valve section mounted on a stem which is used to move the valve between an open and a closed position. The stem typically rides in a valve guide which is made or cut from the same material as the balance of the head. The guide will include an aperture that has been machined to provide a smooth finish and which will accept the valve stem and allow lubrication and sliding motion of the stem within the guide. Since the head is typically made from a relatively mild material, the valve guide must be of a size that allows significant distribution of the loads imposed by the stem. This frequently requires that the valve guide and valve guide boss protrude into the runner or flow ducts provided by the head. The protrusion of the valve guide boss into the runner limits the effectiveness of the runner. The flow of gas that can be delivered by the runner is thus limited to the maximum amount deliverable through the constriction produced by the valve guide boss.

It is known that valve guide inserts may be incorporated into the head. The practice of using valve guide inserts is known, and particularly common in re-conditioning of heads with valve guides that have been significantly enlarged during service. Known designs for valve guide inserts such as the insert taught in British Patent No. 196,653 to A. J. Hawes Elverson which teaches the use of a threaded valve guide which attaches to the head by means of the threads. Another known valve guide is shown in British Patent No. 202,028 to C. Frederick Ryland, which again shows a threaded valve guide that is threadably connected directly to the head of the motor. Other known valve insert devices which include threaded portions include U.S. Pat. No. 908,604 to Odenkirchen. These inserts, however, do not provide a means for progressively tightening the fit of the guide in the head.

Yet another known valve guide insert is taught in British Patent No. 159,822 to E. Bougatti. The Bougatti invention includes a valve guide which is conical in shape and which includes a threaded portion that has been adapted to extend over the top surface of the head once installed. This valve guide is driven into the head where it is retained by the elastic deformation of the valve guide and the head. The threaded portion of the Bougatti valve guide serves for providing a surface which may be used to pull and extract the guide when necessary to do so.

Other known devices include French Patent No. 924,584 to the Austin Motor Company, Limited, and which teaches a two part valve guide, with one part being threadably attached to the runner side of the head.

It is known that it would be advantageous to provide a valve guide seal to control lubrication of the stem as it moves within the guide. Examples of these devices include U.S. Pat. No. 3,885,546 to Foley et al., and U.S. Pat. No. 4,124,220 to Leone et al.

Still other known valve guide designs reveal configurations with contours on the external surface of the valve guide. For example, the configuration of the valve guide disclosed in U.S. Pat. No. 2,222,457 to Scheibe includes two ends and a mid portion. The mid portion being of a smaller diameter than the two end portions. The first end being smaller than the second end, so that the guide may be inserted from upper surface, or exterior of the head, towards the runner. Unfortunately, however, the insertion of the guide from the exterior of the head towards the runners presents the disadvantage that retention and sealing of the insert is made difficult by the fact gases for combustion tend to exert a resultant force in the direction in which the insert may be removed. This may lead to loosening and leakage of fluids, and even complete separation of the insert from the head.

A review of known devices reveals that there remains a need for a valve guide insert which can be used as a retrofit for existing heads to reduce the size of the valve guide boss and its effects on the flow through the runner or flow duct in the head.

Still further, there remains a need for a valve guide insert that can be progressively tightened against the head.

Importantly, known devices have not addressed the need for a a simple valve guide system that allows the control of oil delivery to the valve stem, and thus reduce the seepage of oil between the stem and the guide with wear of the guide.

SUMMARY

It has been discovered that the problems left unanswered by known art can be solved by providing a valve stem support system that includes the following elements:

a) a valve guide insert that has a first end and a second end, the valve guide insert also includes an external surface which is of a diameter near the first end and includes an enlarged area or portion between the first end and the second end; and b) tensioning means for providing tension to the valve guide once installed.

In a preferred embodiment of the invention the tensioning means on body of the valve guide is a threaded section. The threaded section allows the guide to be inserted into the head from the runner side of the head and then tightened on the side the head where the valve pads and springs are to be mounted.

It is contemplated that the threaded section of the valve guide will be tightened by means of a nut or the like which will allow the introduction and maintenance of a tension load on the body of the valve guide. Additionally, it is contemplated that the nut or fastening means will bear against a valve spring seat which includes a cupped portion, a thermal barrier which may also serve as a lubrication control seal, and a bearing plate. The thermal barrier being held between the bearing plate and the cupped portion of the spring seat. The compression of the valve spring will be maintained by a spring retainer which accommodates a thermal barrier and a bearing plate. The thermal barrier being held between the bearing plate and the retainer.

It should be noted that several new and useful results can be achieved with the disclosed invention. For example, the body of the valve guide may include or accept a faired or include an aerodynamic portion which serves as a vane to induce swirling of gases as they move through the runner and past the valve guide disclosed herein. The induction of swirling of the gases by the aerodynamic cross section will enhance the mixing of the gases as it introduced to the combustion chamber. Additionally, the vane or aerodynamic contouring of the valve guide will reduce the variation in pressure across the bend area of the runner where the valve stem extends. By enhancing the uniformity of the pressure of the gas flow, one enhances the uniform mixture and combustion of the gases once they enter the combustion chamber of the engine.

Still further, the disclosed invention produces new and useful results in that it provides support for the valve stem with little encroachment into the flow area to be provided by the runner. Since the disclosed invention provides support for the valve stem, it is contemplated that the invention may be used as a system for reducing the amount of flow area taken up by the structure needed to support the valve stem.

Additionally, the disclosed structure clamps itself against the roof of the runner. This eliminates on the reliance for an interference fit for maintaining the valve guide insert at the proper position in the head. Known head/valve guide boss arrangements can now be modified by reducing the valve guide boss, without the danger of reducing the amount of material left to support the valve guide insert and without the risk of cracking or damaging the head/valve guide bosses due to the increase in stresses introduced by press-fitting the valve guide inserts into the valve guide bosses.

Furthermore, the clamping action of the disclosed invention allows increases the contact area of the between the valve guide insert and the head by simply varying the with of the enlarged section or collar of the disclosed valve guide body, which produces improved heat transfer characteristics for the valve guide. The improved heat transfer characteristics allows the use of a smaller valve stem contact area, which again in turn leads to less interference with the flow characteristics of the runner.

Another important aspect of the disclosed invention is that it eliminates the need to cut threads into the head. By eliminating the use of threads cut into the head one eliminates stress concentrations which can lead to cracking of the head itself. Furthermore, the installation a threaded insert would typically have to be carried out by adding some sort of thread anti-seizing compound between the insert and the head to allow removal of the insert at a later time. This compound will inevitably degrade the heat transfer characteristics of the assembly, and increase the likelihood of failure of lubricants used to keep the valve stem moving freely within the valve guide.

Still further, the reduction of the valve guide boss allows the designer to give the runner an optimal flow path. For example, the flow path through the runner may be configured to produce an acceleration of the flow (by introducing a smooth, gradual constriction) which is unspoiled by the protrusion of the valve guide boss.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it being understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
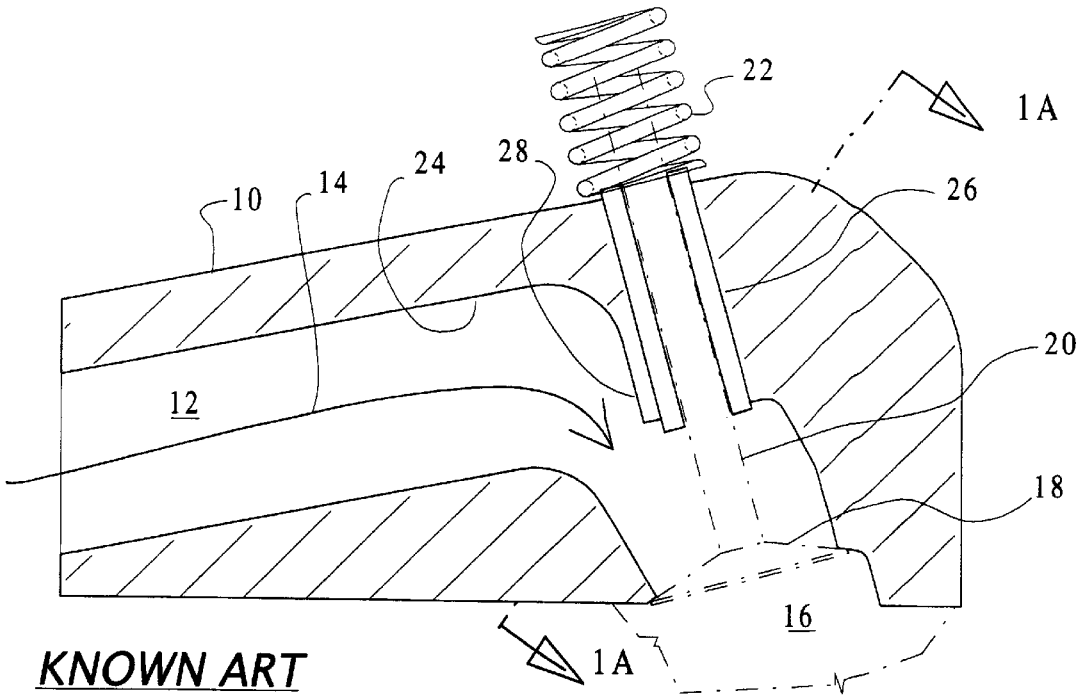
FIG. 1 is section of a known arrangement within a runner, the view illustrating the typical arrangement of the valve guide boss and valve in the head.

Turning now to FIG. 1, where a section of a known head 10 for use with an internal combustion engine is shown. The head 10 includes runners 12, which are ducts that carry gases 14, such as fuel vapors with air or simply air to be mixed with fuel in the engine's combustion chamber 16. Runners 12 are also used for providing an escape route for the products of combustion. To control the flow of gases 14 to and from the combustion chamber 16 and into the runners 12, valves 18 which are activated through stems 20 are placed near the end of the runner 12. The stems 20 are typically biased by valve springs 22 to hold the valve in a normally closed position.

Also shown on FIG. 1 is that the stems 20 of the valves 18 extend through the roof 24 of the runner 12, and are supported by known valve guides 26, which provide a smooth, hard contact surface that allows extended service of the valve mechanism. The known valve guides 26 are supported in the head 10 by valve guide bosses 28, which extend into the runner 12.

Figure 1A:
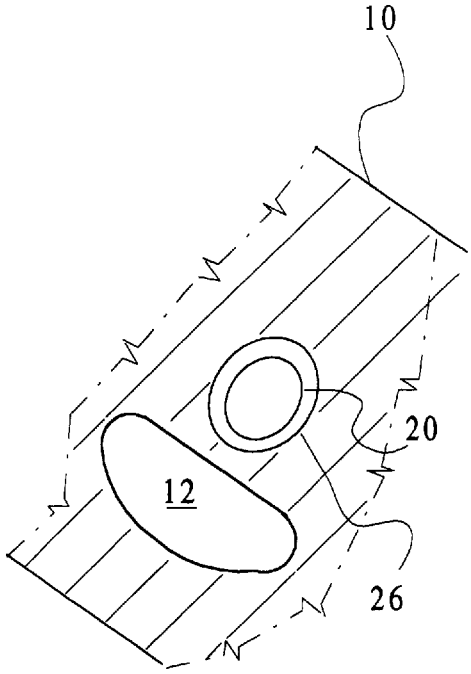
FIG. 1A is a sectional view taken from FIG. 1 at the location indicated on FIG. 1, and illustrates the reduction in effective runner cross-section by the protrusion of the valve guide boss into the runner.

Turning now to FIG. 1A, which is a cross section of the flow duct or path established by the runner 12, though the boss 28 and the known valve guide 26. FIG. 1A illustrates the dramatic reduction in flow path cross-section produced by the extension of the boss 28 into the runner 12.

Figure 2:
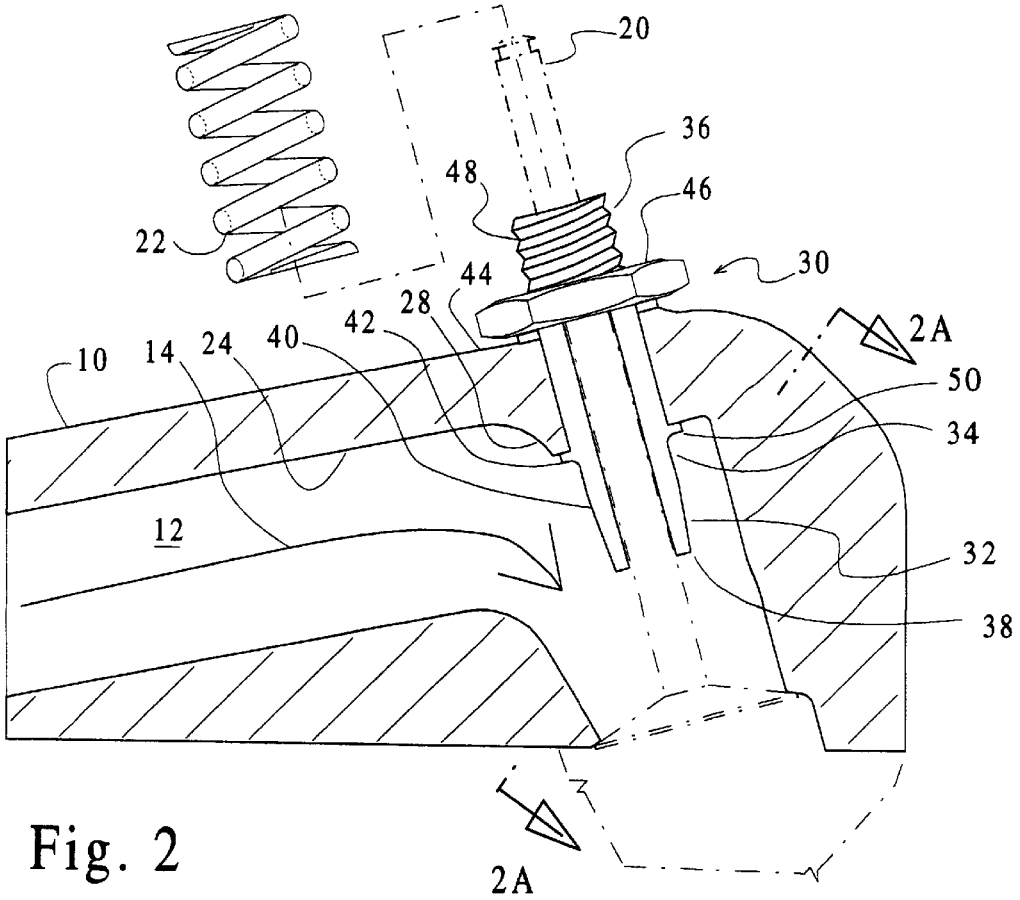
FIG. 2 illustrates a preferred embodiment of the invention, the view showing support of the valve stem supported with the disclosed invention.
Figure 2A:
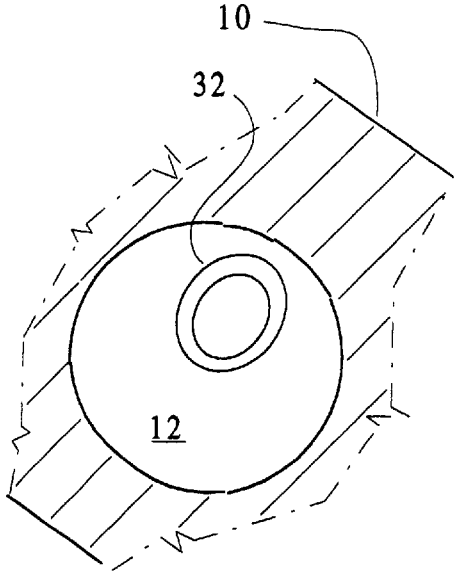
FIG. 2A is a section taken from FIG. 2, and the view showing the increase of the effective area of the runner once the valve guide boss has been reduced and the valve stem is supported with the disclosed invention (as compared with the arrangement shown on FIG. 1A).

Referring now to FIG. 2, it where the disclosed system 30 is shown installed in a head that originally had been configured as shown on FIG. 1. FIG. 2A is a cross-section taken from FIG. 2, along the corresponding location of the section shown in FIG. 1A.

FIGS. 2 and 2A illustrate that a highly preferred embodiment of the system 30 includes a valve guide 32 which includes a body 34 with a first end 36 and a second end 38. The first end 36 will preferably include means for introducing or holding a load along the body 34 of the valve guide 32. To oppose or retain this load, the body 34 will preferably include an external surface 40 with a protrusion or enlarged section 42. It is contemplated that the enlarged section may be embodied as an attachment or even by incorporating a generally conical shape to the exterior surface 40 at a location between the first end 36 and the second end 38 of the body 34. Additionally, it is contemplated that the size of the footprint or contact area enlarged section 42 against the valve guide boss 28 or roof 24 of the runner 12 may be modified to control the heat transfer characteristics of the valve guide insert 32. As previously discussed, the clamping action achieved with the disclosed invention allows the installation of the valve guide without the need to press fit the guide into the head, eliminating the introduction of stresses or stress concentrations into the head 10.

It is important to note that, as shown on FIG. 2, it is contemplated that the second end 38 will be installed such that it will extend towards the runner 12, while the first end 36 extends away from the runner 12. Thus, it is contemplated that the valve guide 32 will be inserted into the head 10 through the runner 12, and tightened against the upper surface 44 of the head 10. By tightening the valve guide 32 against the upper surface 44 of the head 10 and restricting the movement of the body 34 from the runner side towards the upper surface 44 by incorporating a protrusion or variation in size of the body 34 one can establish a tension load on the body 34 by pulling on the body 34 with the aid of tensioning means located near the first end 36 of the body 34. In a preferred embodiment of the invention the tensioning means includes a nut 46 which cooperates with threads 48 on the first end 36 of the body 34.

The disclosed arrangement allows the system 30 to be used as part of original equipment on the heads or as a system for modifying an existing head to reduce the protrusion or extension of the valve guide boss 28 into the flow path established by the runner 12. To reduce the protrusion of the valve guide boss 28 one would simply reduce the height of the boss, for example, from the height shown on FIG. 1 to the height shown on FIG. 2. Then the first end 36 of the valve guide 32 would be inserted from the runner side into the aperture in the boss for accepting the guide 32. Once the first end 36 emerges from the head through the upper surface 44 of the head, the nut 46 may then be used to pull the body 34 until a desired amount of tension is introduced into the body 34.

It will be understood that by tightening the body 34 by means of a nut or other means for establishing the tension load, such as a racheting connector, a barbed connector, or other connector that can establish a tension load on the body 34 reduces the need for having a large boss to support the valve guide. One reason for reducing the need of a large boss is that the tensioning means replaces any loss of retention preload produced by the reduction of surface contact area between head and the external surface of the valve guide. Also, it is known that the contact between the valve and the boss allows good heat transfer characteristics which allows cooling of the valve guide and the lubricating oil passing through the valve guide between the guide and the valve stem 20. Thus the disclosed system 30 allows the user to establish intimate contact between the valve guide 32 and the head 10 by means of a bearing contact between the protrusion 50 and the reduced boss or head and, where desired, bearing contact between the nut 46 and the head 10.

Thus, referring to FIG. 2A, it will be understood that the disclosed invention will allow reduce the flow restriction effects of the boss on the runner, allowing the modified runner to present an enhanced, enlarged flow path for gases traveling through the runner 12.

Figure 4:
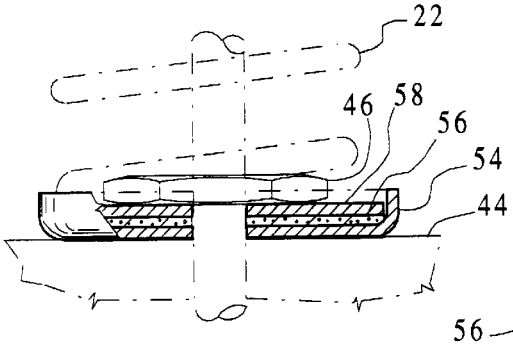
FIG. 4 is an exploded view of a contemplated valve spring retention assembly to be used with the disclosed system. The illustrated components serve to insulate the spring used to bias the valve stem in a closed position.
Figure 5:
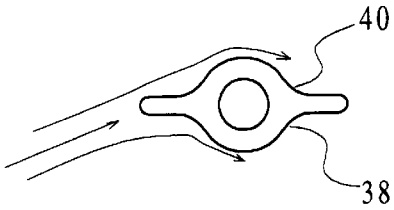
FIG. 5 is a cross-section of a contemplated cross section of the body of the valve guide used with the instant invention.
Figure 3:
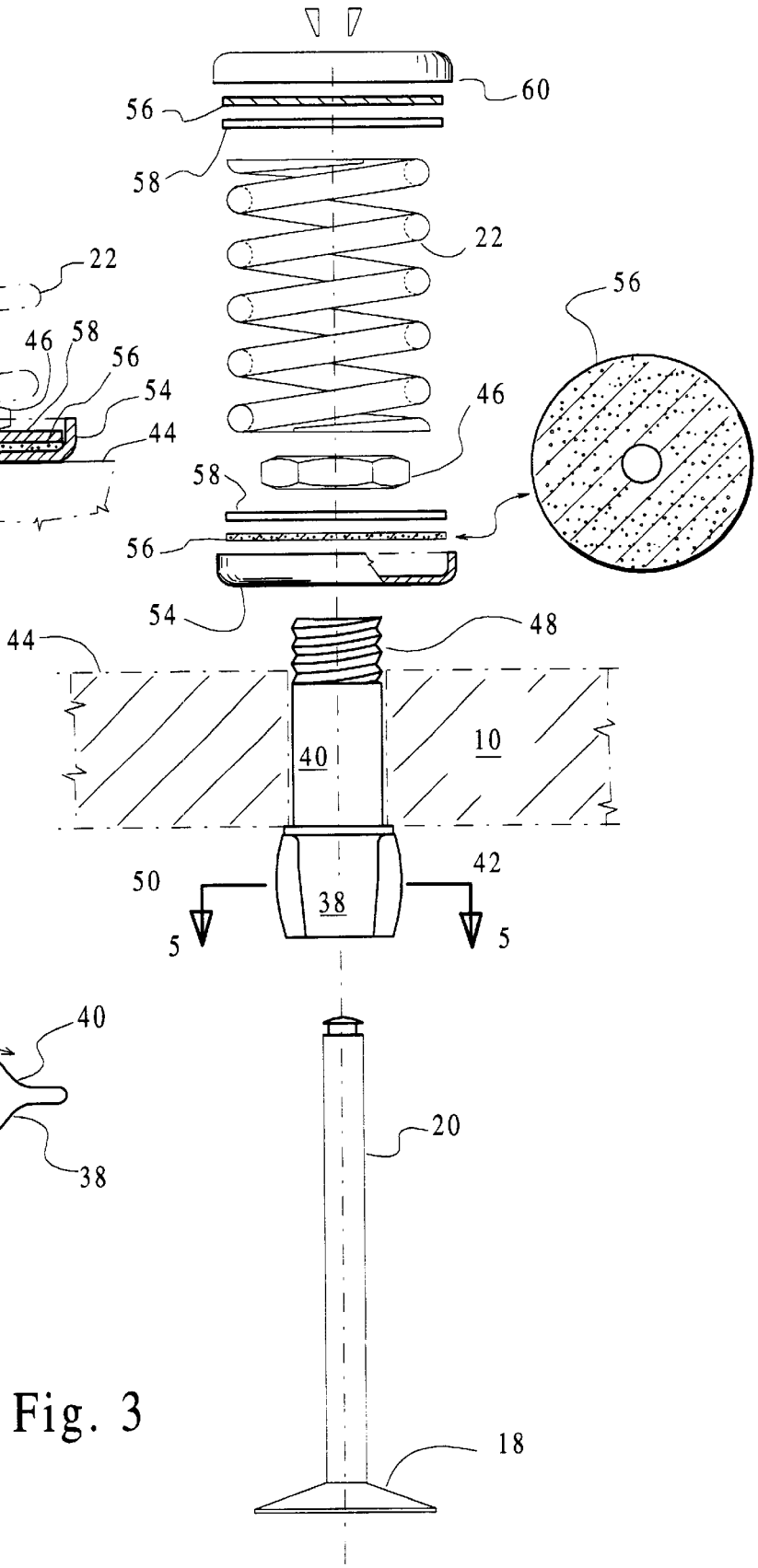
FIG. 3 is an exploded view of components used with the instant invention and the assembly of the valve stem within the disclosed system.

To further illustrate novel aspects taught herein, FIGS. 3 through 5 provide an exploded view of preferred components to be used with the system 30. More particularly, FIGS. 3 and 4 show that in addition to allowing the user to produce a smooth flowing runner, the disclosed structure allows the user to incorporate a spring seats 52 which include a cupped portion 54, which holds a thermal barrier 56 that is retained between the spring 22 and the cupped portion 54. Most preferably, however, it is contemplated that a bearing plate 58 will be incorporated between the spring 22 and the thermal barrier 56. The thermal barrier 56 will preferably be constructed from a suitable permeable material, and most preferably of a suitable resilient permeable material. It is contemplated that the use of a resilient permeable material for the thermal barrier will allow the cupped portion 54 to collect oil distributed in rocker arm area over the upper surface 44 of the head 10. Once collected in the cupped portion the oil can filter through and into the thermal barrier 56 where it then contacts the stem 20 of the valve 18. It should be understood that the resiliency and limited permeability of the thermal barrier 56 will control the seepage of oil to the region between valve stem 20 and the valve guide 32.

FIG. 4 illustrates that it is also contemplated that an assembly which includes a spring retainer 60, a thermal barrier 56, and a bearing plate 58 between the spring 22 and the thermal barrier 56. By incorporating a thermal barrier 56 on both ends of the spring 22, one reduces the possibility of heat transfer from the valve stem 20 and into the spring 22.

Turning to FIG. 5, yet another important aspect of the invention has been disclosed. As shown in this view, it is contemplated that a portion of the valve guide 32 may include an aerodynamic profile, and most preferably, it may incorporate a vane profile that promotes the induction of swirling of gasses as they pass by the valve guide 32.

Figure 6:
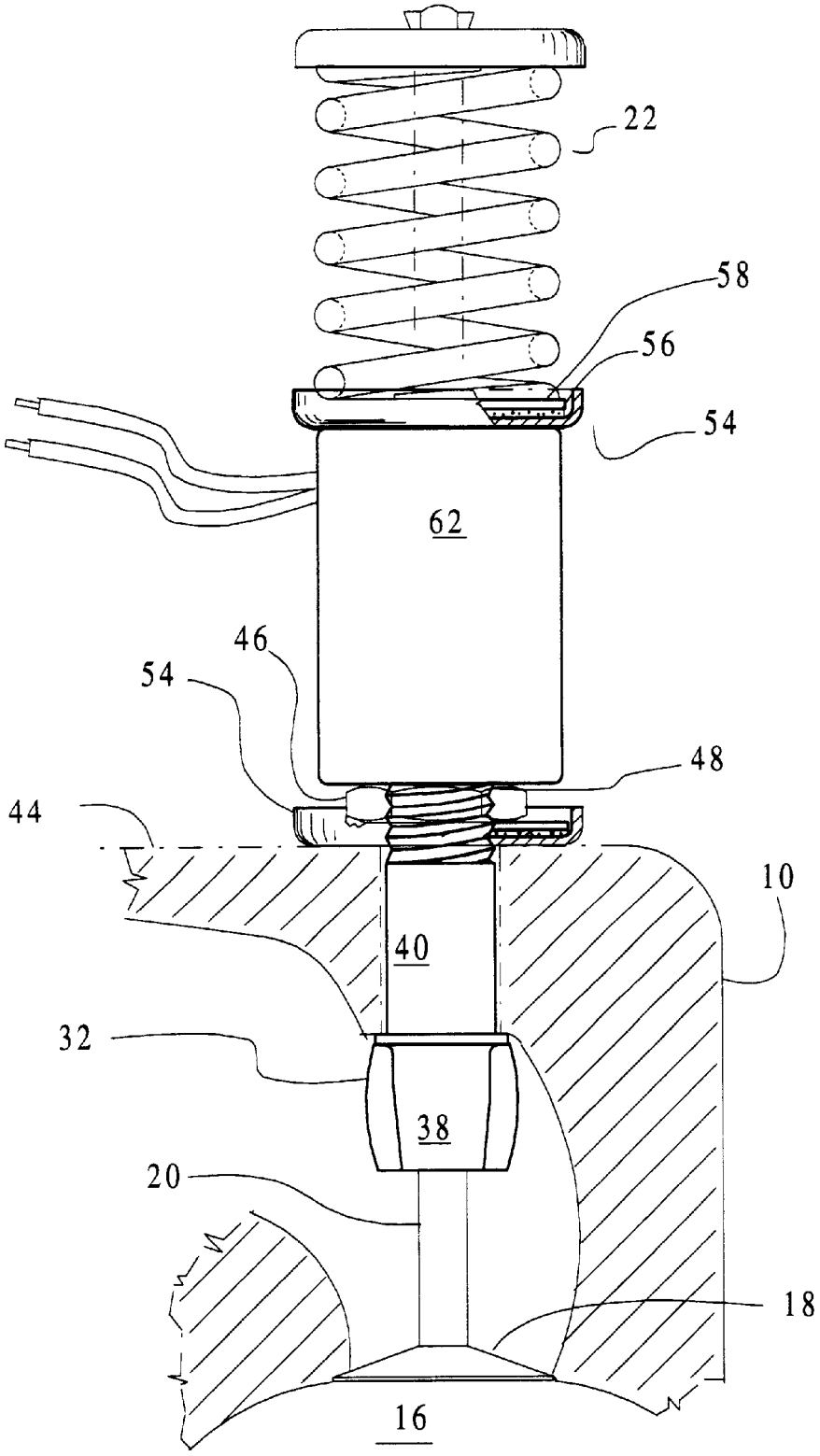
FIG. 6 illustrates the use of the instant invention with a solenoid as a means for moving the valve stem and opposing the bias of the valve spring.

It is important to note that it is contemplated that the disclosed system may be modified without departing from the spirit and scope of the invention. For example, as shown on FIG. 6, it is contemplated that the valve stems may be moved by means of a solenoid 62, or similar linear actuation mechanism, which in turn is used to operate the valve 18. In this application the thermal barrier 56 would be placed between the upper surface 44 and the solenoid 62, as well as on at least one end of the spring 22. The illustrated installation would will allow the use of an electrically operated solenoid 62 which may be attached directly to the threaded portion 48 of the valve guide 32.

Thus, it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A valve guide insert for use on a cylinder head having an upper surface and at least one runner extending below the upper surface, the runner having a roof, the cylinder head further having an aperture for accepting a valve guide, the aperture extending from the upper surface down to the roof of the runner, the valve guide insert comprising:

a valve guide body having a first end and a second end, an aperture adapted for accepting a stem portion of a poppet valve and an external surface, the external surface of the valve guide body near the first end being of a size adapted for insertion of the first end into the aperture in the head at the roof of the runner, the valve guide body further including an enlarged portion, the enlarged portion is larger than the aperture at the roof of the runner of the head, the enlarged portion located between the first end and the second end of the valve guide body; and tensioning means for providing tension to the valve guide body, the tensioning means being located near the first end of the valve guide body and adapted for increasing the tension against the head, so that a tension load is introduced on the valve guide body by using the tensioning means to pull on the first end of the valve guide body when the enlarged portion engages the head about the aperture in the head.

2. A valve guide insert according to claim 1 wherein said tensioning means comprise a threaded portion.

3. A valve guide insert according to claim 1 wherein said enlarged area comprises a protrusion extending from the external surface of the body.

4. A valve guide insert according to claim 2 wherein the external surface of the body includes a conical transition between the enlarged area near said second end and the surface near the first end.

5. A valve guide insert according to claim 1 wherein the external surface of the body near said second end includes means for controlling the flow of a fluid passing over the second end.

6. A valve guide insert according to claim 5 wherein said means for controlling the flow of a fluid passing over the second end comprises a vane.

7. A valve guide insert for use on a cylinder head having an upper surface and at least one runner extending below the upper surface, the runner having a roof, the cylinder head further having an aperture for accepting a valve guide, the aperture extending from the upper surface down to the roof of the runner, the valve guide insert comprising:

a valve guide body having a first end and a second end, an aperture adapted for accepting a stem portion of a poppet valve and an external surface, the external surface of the valve guide body near the first end being of a diameter adapted for insertion of the first end into the aperture in the head near the roof of the runner, the valve guide body further including an enlarged portion, the enlarged portion is larger than the aperture in the head near the roof of the runner, the enlarged portion located between the first end and the second end of the valve guide body; and tensioning means for providing tension to the valve guide body, the tensioning means being located near the first end of the valve guide body and adapted for increasing the tension against the head, so that a tension load is introduced on the valve guide body by using the tensioning means to pull on the first end of the valve guide body when the enlarged portion engages the head about the aperture in the head.

8. A valve guide insert according to claim 7 wherein said tensioning means comprise a threaded portion.

9. A valve guide insert according to claim 7 wherein said enlarged area comprises a protrusion extending from the external surface of the body.

10. A valve guide insert according to claim 8 wherein the external surface of the body includes a conical transition between the enlarged area near said second end and the surface near the first end.

11. A valve guide insert according to claim 7 wherein the external surface of the body near said second end is includes means for controlling the flow of a fluid passing over the second end.

12. A valve guide insert according to claim 11 wherein said means for controlling the flow of a fluid passing over the second end comprises a vane.

13. A method for supporting a valve guide insert for use on a cylinder head, the cylinder head having an upper surface and at least one runner extending below the upper surface, the runner having a roof, the cylinder head further having an aperture for accepting a valve guide, the aperture extending from the upper surface down to the roof of the runner, the method comprising:

providing a valve guide body having a first end and a second end, an aperture adapted for accepting a stem portion of a poppet valve and an external surface, the external surface of the valve guide body near the first end being of a size adapted for insertion of the first end into the aperture in the head through the roof of the runner, the valve guide body further including an enlarged portion, the enlarged portion is larger than the aperture in the roof of the runner, the enlarged portion located between the first end and the second end of the valve guide body; and tensioning means for providing tension to the valve guide body, the tensioning means being located near the first end of the valve guide body and adapted for increasing the tension against the head, inserting the first end of the valve guide body into the aperture in the head, the insertion being carried out from near the roof portion towards the upper surface of the head; introducing a tension load on the valve guide body by using the tensioning means to pull on the first end of the valve guide body when the enlarged portion engages the head about the aperture in the roof of the runner.

14. A method according to claim 13 wherein said tensioning means comprises a threaded portion.

15. A method according to claim 14 wherein said enlarged area comprises a protrusion extending from the external surface of the body.

16. A method according to claim 14 wherein the external surface of the body includes a conical transition between the enlarged area near said second end and the surface near the first end.

17. A method according to claim 13 wherein the external surface of the body near said second end is includes means for controlling the flow of a fluid passing over the second end.

18. A method according to claim 17 wherein said means for controlling the flow of a fluid passing over the second end comprises a vane.

* * * * *